US005219696A

United States Patent [19]

Demizu et al.

[11] Patent Number: 5,219,696

[45] Date of Patent: Jun. 15, 1993

[54] TONER FOR DEVELOPING ELECTROSTATIC LATENT IMAGE

[75] Inventors: Ichiro Demizu, Toyonaka; Mitsutoshi Nakamura, Ibaragi; Hiroshi Fukao, Toyokawa, all of Japan

[73] Assignee: Minolta Camera Kabushiki Kaisha, Osaka, Japan

[21] Appl. No.: 798,118

[22] Filed: Nov. 26, 1991

[30] Foreign Application Priority Data

Nov. 30, 1990 [JP] Japan ..... 2-337538
Nov. 30, 1990 [JP] Japan ..... 2-337539
Nov. 30, 1990 [JP] Japan ..... 2-337540

[51] Int. Cl.[5] ..... G03G 9/097
[52] U.S. Cl. ..... 430/110; 430/111
[58] Field of Search ..... 430/110, 111

[56] References Cited

U.S. PATENT DOCUMENTS 4,623,605 11/1986 Kato et al. ..... 430/110
4,803,144 2/1989 Hosoi ..... 430/110 X
4,933,251 6/1990 Ichimura et al. ..... 430/111 X
4,943,506 7/1990 Demizu et al. ..... 430/111 X
5,021,317 6/1991 Matsubara et al. ..... 430/110

FOREIGN PATENT DOCUMENTS 10654 1/1987 Japan ..... 430/110
129866 6/1987 Japan ..... 430/110
62667 3/1989 Japan ..... 430/110
91143 4/1989 Japan ..... 430/110
223468 9/1989 Japan ..... 430/111
2-108069 4/1990 Japan .

*Primary Examiner*—Roland Martin
*Attorney, Agent, or Firm*—Burns, Doane, Swecker & Mathis

[57] ABSTRACT

The present invention relates to a toner for developing electrostatic latent images, comprising titanium oxide or aluminum oxide having two peak values within the range between 10 and 20 mμm and between 30 and 60 mμm in primary particle size.

21 Claims, No Drawings

TONER FOR DEVELOPING ELECTROSTATIC LATENT IMAGE

BACKGROUND OF THE INVENTION

This invention relates to toners for developing electrostatic latent images in electrophotography, electrostatic recording and electrostatic printing.

Stable copied images of high quality are obtained in electrophotography by visualizing directly or by inversely developing electrostatic latent images, wherein a cascade developing method (U.S. Pat. No.2,297,691, U.S. Pat. No. 2,618,552), a magnetic brush developing method (U.S. Pat. No. 2,832,311) using a developer composed of toner and carrier, a touch-down developing method (U.S. Pat. No. 412,931) or a non-magnetic one component developing method (U.S. Pat. No. 3,731,146) using a developer only composed of toner is used.

As for a toner suitable for those developing methods, a dye as a charge controlling agent, a pigment as a coloring agent and a wax as a peeling agent and the like are mixed with a thermosetting resin and the mixture is kneaded, pulverized and classified to prepare toner particles of mean particle size of 4 to 25 μm. Inorganic fine particles such as silica, titanium oxide or aluminum oxide are usually added to endow the toner with fluidity and to improve cleaning properties.

However, some kinds of the inorganic fine particles, for example, titanium oxide have large primary particle size of up to 50 mμ. When such a titanium oxide of large particle size is used, there arise problems such as poor fluidity, low amount of initial charge due to decreased contact probability with carrier particles, so that copied images have many fogs and are poor in fine texture.

In the case of silica, silica is electrically charged to so high level that toner is also charged to high level. The concentration of copied images is lowered. Silica particles added to the toner usually have small particle size and, when they are used by being mixed with the carrier, there arises another problem that fluidity of the toner decreases because silica particles are buried into the toner surface. Silica tends to absorb moisture on its surface and is not good in moisture resistivity. Though a technique to apply hydrophobic treatment on the surface of silica particles has been proposed to solve the problem, further improvement in environmental resistivity has been desired yet.

SUMMARY OF THE INVENTION

This invention provides a toner excellent in fluidity, chargeability and environmental stability.

This invention also provides a toner which can form copied images with high quality, excellent in fine texture and high image density without generation of toner fogs.

This invention relates to a toner for developing electrostatic latent images, comprising titanium oxide or aluminum oxide having two peak values within the ranges of 10 to 20 mμ and 30 to 60 mμm in primary particle distribution.

DETAILED DESCRIPTION OF THE INVENTION

This invention provides a toner excellent in electrification-build-up properties and charging stability and also excellent in image quality (fogging, fine texture and the like).

Therefore, this invention relates to a toner for developing electrostatic latent images comprising titanium oxide or aluminum oxide having two peak values within the ranges of 10 to 20 mμm and 30 to 60 mμm in primary particle distribution.

Titanium oxide or aluminum oxide having peak value within the range of 10 and 20 mμ in primary particle distribution (referred to as "small particles" hereinafter) is used and titanium oxide or aluminum oxide having peak value within the range of 30 to 60 mμ in primary particle distribution (referred to as "large particles" hereinafter) is also used in this invention.

Fluidity, chargeability and fine texture in copied images, which are deficiencies in large particles, are improved when titanium oxide of small particles are added with titanium dioxide of large particles according to this invention.

The total amount of the large and small particles added to a toner is from 0.2 to 3.0% by weight, preferably from 0.2 to 2.0% by weight on the basis of the toner. When the amount is smaller than 0.2% by weight, the effect of the addition of these particles can not be obtained. When the amount is larger than 3.0% by weight, the charge level is made too low.

Mixing ratio of small particles to large particles is in the range of 1:9 to 1:1, preferably 1:4 to 2:3. When the ratio of the large particles exceeds 1:9, fluidity, chargeability and fine texture in copied image are improved insufficiently. If the ratio of the large particles is smaller than 1:1, deterioration in the fluidity, decrease in copied image density and the like arise. Because it can not be prevented sufficiently that small particles are buried into toner particles when toner and carrier are mixed and stirred.

It is preferable that titanium oxide or aluminum oxide added to a toner is subjected to hydrophobic treatment for the purpose of improving environmental stability.

Various kinds of coupling agents such as silanes, titanates, aluminates, zirco-aluminates and the like, and silicone oil are used as hydrophobic agents. Examples of silanes are chlorosilanes, alkyl silanes, alkoxy silanes and silazanes.

Alkyl polysiloxanes composed of repeating structural unit represented by the following formula [I]:

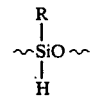

[I]

in which R is an alkyl group which may be branched, and no functional groups that react with —OH groups at their molecular terminals are used preferably. The hydrogen atom bonding to silicone atom in the formula [I] is an active hydrogen. The presence of this active hydrogen enables formation of two dimensional or three dimensional polymer film of alkyl polysiloxanes on the surface of inorganic fine particles, thereby making the particles hydrophobic.

The above-described inorganic fine particles are coated with alkyl polysiloxane represented by the formula [I] as follows; the particles are coated with polysiloxane itself or a coating solution of polysiloxane dissolved in an appropriate solvent (xylene, trichloroethylene, perchloro-ethylene or methylene chloride etc.) by an appropriate method of spraying, dipping and the like followed by drying.

The amount of alkyl polysiloxane to be used is from 1 to 15% by weight, preferably 2 to 10% by weight, on the basis of the inorganic fine particles. When the amount is less than 1% by weight, the inorganic fine particles are not made hydrophobic sufficiently, resulting in low electronic charge level or appearance of fogs on paper ground. When the amount is larger than 15% by weight, adhesion among the particles by the following heat treatment is brought about and, moreover, the excessive addition does not contribute to charging stability.

Heat treatment is applied after the inorganic fine particles are coated with alkyl polysiloxane and dried. A polymer film of alkyl polysiloxane coated on the surface of inorganic fine particles is formed by heat treatment. Hydrogen atom in the formula [I] is active. By heating, the molecules are thought to be bound with each other via oxygen atom in the air as is shown in the following reaction equation;

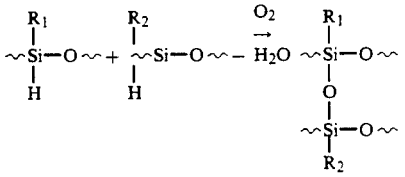

A coating film of polysiloxane is recognized to be formed by the equation described above and not by a reaction with OH groups on the surface of the inorganic fine particles. Appropriate alkyl groups ($R_1$ and $R_2$) are those with bulkyness such that the binding of siloxanes with each other does not suffer from steric hindrance.

Heat treatment is carried out at 120° C. to 180° C., preferably at 130° C. to 160° C. in the air.

The application of the inorganic fine particles obtained as described above makes a toner excellent in electrification-build up properties, uniformity of charging, fluidity and stability of electrostatic charge, as well as in fluidity and cleaning ability.

In the present invention, it is preferable to use silica together with titanium oxide or aluminum oxide mentioned above. The combination of these silica with titanium oxide or aluminum oxide effects fluidity and fine texture of copied-images.

Silica used in conventional toners which have primary particle size of 5 to 20 mμ is used in this invention. The silica is subjected to a hydrophobic treatment in the same manner as the titanium oxide or aluminum oxide. Various kinds of silica, hydrophobic silica R-972 (primary particle size of 16 mμ: made by Nihon Aerosil K.K.), hydrophobic silica R-974 (primary particle size of 12 mμm: made by Nihon Aerosil K.K.) and hydrophobic silica R-976 (primary particle size of 7 mμ: made by Nihon Aerosil K.K.), for example, are available in the market. Silica is added in an amount of 0.1 to 1.0% by weight, preferably 0.1 to 0.5% by weight, on the basis of the toner in this invention. When the amount is smaller than 0.1% by weight, the effect of the addition of silica can not be obtained. When the amount is 1.0% by weight or more, high electrostatic charge level and inferior environmental resistivity of silica influence adversely.

Titanium oxide particles or aluminum oxide particles having a peak value within the range of 10 to 20 mμ in primary particle distribution are effective in suppressing high electrostatic charge of silica and improving environmental stability while maintaining the advantages of silica such as good fluidity and fine texture in copied image. Titanium oxide particles or hydrophobic aluminum oxide particles having a peak value within the range of 30 to 60 mμ in primary particle distribution effectively prevent silica and small particles from being buried into the toner particles, so that an effect of keeping fluidity and electrostatic charge stability for a prolonged period of time can be achieved. In particular, in the case of light-transmittable color toner used in the color-copy machine, the problem that silica or small particles are buried into the toner is made more predominant because more soft resin compared to that used in the conventional black toner is particularly used in the light-transmittable color toner in order to maintain its light-transparency. This invention is also effective in such a light-transmittable color toner.

Known methods are applied to adhere inorganic fine particles to the surface of toner. The toner is mixed with inorganic fine particles at a conventional ratio and stirring in a mixer or a blender.

Toners to which inorganic fine particles according to this invention is added are usually fine particles which are composed of at least a coloring agent and a binder resin such as acrylic resins, polystyrene reins, polyester resins, styrene-acrylic copolymer resin or epoxy reins. The toners may be the ones which are used together with magnetic carrier particles, the ones of single component of non-magnetic type, and the ones of single component containing a magnetic agent ( a magnetic toner). Any of these toners can be applied in this invention.

Light-transmittable toners are composed at least of polyesters and coloring agents.

Such a polyester resin is exemplified by the one obtained, for example, by condensation-polymerization reactions of bisphenols, ethylene glycol, triethyleneglycol, 1,2-propyleneglycol or 1,4-butane diol with aliphatic unsaturated difunctional acids such as maleic acid or itaconic acid, or dibasic acids such as phthalic acid, terephthalic acid, isophthalic acid, malonic acid or succinic acid. Modified polyester resins are preferable from the point of improving environmental stability, in which unsaturated polyesters are particularly contained and aromatic vinyl monomers are subjected to graft-polymerization to the unsaturated polyester. The ratio of the polyester in this modified polyester is 50% by weight or more, preferably 60 to 90% by weight.

Preferable polyester resins have number average molecular weight (Mn) of 2500 to 12000, degree of dispersion (Mw/Mn) of 2 to 6, glass transition temperature (Tg) of 50° C. to 70° C. and melting point (Tm) of 80° C. to 120° C. When the polyester resin does not meet the properties above mentioned, light-transmittable property of the toner becomes insufficient, and fixing properties and heat resistance are lowered.

Various kinds of pigments and dyes which are conventionally used in light-transmittable color toners can be used.

Desired additives such as charge controlling agents and the like other than coloring agents may be added to a toner.

Coloring agents and other additives required by toner are used in an amount conventionally used to prepare a toner with mean particle size of 4 to 25 μm, preferably 6 to 12 μm and more preferably 6 to 10 μm by a kneading and pulverizing method.

Concrete examples of this invention are described below.

Manufacturing Example of Titanium

Titanium dioxide (MT600B; made by Teika K.K.) with a peak value of 50 mμ in primary particle distribution and titanium dioxide (MT150A; Teika K.K.) with a peak value of 15 mμ in primary particle distribution were mixed in a ratio of 7 (MT600B) : 3 (MT150A). One hundred parts by weight of this mixture were spray-coated with a solution of 5 parts by weight of silicone oil represented by the following structural formula:

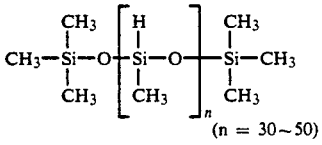

[i]

(n = 30~50)

diluted with 50 parts by weight of xylene. The titanium dioxide obtained was subjected to heat treatment at 150° C. for one hour after drying. Titanium dioxide A subjected to hydrophobic treatment was obtained.

Manufacturing Example 2 of Titanium

One hundred parts by weight of titanium dioxide (MT600B; made by Teika K.K.) with a peak value of 50 mμ in primary particle distribution was spray-coated with a solution of 5 parts by weight of silicone oil represented by the following structural formula:

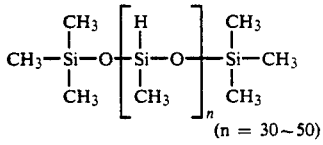

[i]

(n = 30~50)

diluted with 50 parts by weight of xylene. The titanium dioxide obtained was subjected to heat treatment at 150° C. for one hour after drying. Titanium dioxide B subjected to hydrophobic treatment was obtained.

Manufacturing Example of Carrier

A solution of styrene-acrylic resin with solid fraction of 2% was prepared by diluting 80 parts by weight of styrene-acrylic copolymer comprising styrene, methyl methacrylate, 2-hydroxyethyl acrylate and methacrylic acid (1.5:7:1.0:0.5) and 20 parts by weight of butylated melamine resin with toluene.

Sintered ferrite particles (F-300; mean particle size: 50 μm, bulk density: 2.53g/cm$^3$; made by Powdertech K.K.) were used as a core material and they were coated with the above-described solution of styrene-acrylic resin by using SPIRA COTA (made by Okada Seiko K.K.) followed by drying. The carrier obtained was allowed to stand for 2 hours at 140° C. in a hot-air circulating oven for sintering. After cooled, the ferrite particle bulk was crushed and sieved by a vibrating sieve attached with a screen mesh with opening size of 210 μm and 90 μm. Thus, ferrite particles coated with a resin were obtained. The above-described coating, sintering, crushing and sieving of the ferrite particles were repeated three times (primary sintering).

The ferrite particles obtained by primary sintering were subjected to sintering again in the oven described above (secondary sintering). The ferrite bulk was crushed and sieved as described above. Thus, a carrier coated with a resin was obtained.

Mean particle size, the amount of the coating resin (Rc), heat decomposition peak temperature and electric resistivity of the carrier obtained were 52 μm, 2.95%, 295° C. and $4\times10^{10}\Omega$cm, respectively.

The amount of the coating resin was determined as follows:

About 5 g of the carrier coated with resin was placed in a ceramic crucible the weight of which ($W_0$) (g) had been measured precisely, and total weight ($W_1$) (g) were measured. The crucible was placed in a muffle furnace and the temperature of the furnace was raised to 900° C. with temperature increase rate of 15 degree per minute. The coating resin was burnt up while the temperature was kept at 900° C. for 3 hours, followed by cooling to room temperature. Immediately after the temperature reached to room temperature, the weight of the crucible $W_2$(g) with the carrier in it was measured precisely. The amount of the coating resin (Rc) is calculated by the equation below.

$$Rc(\%) = \frac{W_1 - W_2}{W_2 - W_0} \times 100$$

Particle size of the carrier was measured by using a particle size distribution measuring apparatus by laser beam diffraction manufactured by Microtrack K.K.

Bulk density was measured by a bulk density measuring apparatus manufactured by Kuramochi Kagaku Kikai Seisakusho K.K. according to JIS Z 2504.

Heat decomposition peak temperature was obtained by a DSC curve by a thermal analyzer (SSS-5000; made by Seiko Denshi K.K.).

EXAMPLE 1

| | |
|---|---|
| Thermosetting polyester resin (Mn: about. 6100, Mn: about. 202500) | 100 parts by weight; |
| Carbon black MA 100 (made by Mitsubishi Kasei K.K.) | 4 parts by weight; |
| Spilon black TOH (made by Hodogaya Kagaku K.K.) | 3 parts by weight; |
| Viscol 550P (made by Mitsubishi Kagaku K.K.) | 5 parts by weight |

The materials described above were thoroughly mixed by a Henschel mixer and then kneaded by a two-axis extruder, followed by cooling. After the kneaded material was roughly pulverized, particle (1) having particle size of 4 to 20 μm (mean particle size of 10.5 μm) was obtained by using a jet grinder and an air-classifier.

Titanium A prepared in Manufacturing Example 1 of Titanium was added to particle (1) in an amount of 1.0% by weight on the basis of the particle in a Henschel mixer. Thus toner (1) was obtained.

Comparative Example

Toner (2) was obtained by the same method described in Example 1, except that titanium B obtained in Manufacturing Example 2 of Titanium was used instead of titanium A used in Example 1. Thus toner (2) was obtained.

EXAMPLE 2

| | |
|---|---|
| Thermosetting polyester resin (Mn: about. 4300, Mw: about. 12700) | 100 parts by weight; |
| Cyan dye Lionol Blue FG-7350 (made by Toyo Ink K.K.) | 3 parts by weight; |
| Charge controlling agent Bontron E-84 (made by Orient Kagaku K.K.) | 3 parts by weight; |

The above-described materials were treated by the same method as described in Example 1 to obtain particle (2) with particle size of 4 to 20 μm and mean particle size of 10.2 μm.

Titanium A obtained in Manufacturing Example 1 of Titanium was added to particle (2) obtained in the example described above in an amount of 1.0% by weight on the basis of the particle (2) in a Henschel mixer. Thus, toner (3) was obtained.

Comparative Example 2

Toner (4) was prepared by the same method as described in Example 2, except that titanium B obtained in Manufacturing Example 2 of Titanium was used instead of titanium A used in Example 2. Thus, toner (4) was obtained.

EXAMPLE 3

On the basis of particle (1) obtained in example 1, 0.8% by weight of titanium A obtained in Manufacturing Example 1 of Titanium and 0.2% by weight of hydrophobic silica (R-972: Nihon Aerosil K.K.) were used to be adhered to particle (1) in a Henschel mixer. Thus, toner (5) was obtained.

EXAMPLE 4

On the basis of particle (2) obtained in example 2, 1.0% by weight of titanium A obtained in Manufacturing Example 1 of Titanium and 0.2% by weight of hydrophobic silica (R-972: Nihon Aerosil K.K.) were used to be adhered to particle (2) in a Henschel mixer. Thus, toner (6) was obtained.

Comparative Example 3

On the basis of particle (1), 0.8% by weight of titanium B obtained in Manufacturing Example 2 of Titanium and 0.2% by weight of hydrophobic silica (R-972: Nihon Aerosil K.K.) were used to be adhered to particle (1) in a Henschel mixer. Thus, toner (7) was obtained.

Comparative Example 4

On the basis of particle (1), 1.0% by weight of titanium B obtained in Manufacturing Example 2 of Titanium and 0.5% by weight of hydrophobic silica (R-972: Nihon Aerosil K.K.) were used to be adhered to particle (1) in a Henschel mixer. Thus, toner (8) was obtained.

Comparative Example 5

On the basis of particle (1), 0.8% by weight of titanium B obtained in Manufacturing Example 2 of Titanium was used to be adhered to particle (1) in a Henschel mixer. Thus, toner (9) was obtained.

Comparative Example 6

On the basis of particle (1), 0.4% by weight of hydrophobic silica (R-972: made by Nihon Aerosil K.K) was used to be adhered to particle (1) in a Henschel mixer. Thus, toner (10) was obtained.

Comparative Example 7

On the basis of particle (2), 1.0% by weight of titanium B obtained in Manufacturing Example 2 of Titanium and 0.2% by weight of hydrophobic silica (R-972: Nihon Aerosil K.K.) were used to be adhered to particle (1) in a Henschel mixer. Thus, toner (11) was obtained.

Preparations of the toners described above are listed in Table 1.

TABLE 1

| | Toner sample No. | Particle | Post-treatment agent (amount added: weight %) |
|---|---|---|---|
| Example 1 | (1) | Particle 1 | Titanium A (1.0) |
| Comparative Example 1 | (2) | Particle 1 | Titanium B (1.0) |
| Example 2 | (3) | Particle 2 | Titanium A (0.8) |
| Comparative Example 2 | (4) | Particle 2 | Titanium B (0.8) |
| Example 3 | (5) | Particle 1 | Titanium A (0.8); Silica (0.2) |
| Example 4 | (6) | Particle 2 | Titanium A (1.0); Silica (0.2) |
| Comparative Example 3 | (7) | Particle 1 | Titanium B (0.8); Silica (0.2) |
| Comparative Example 4 | (8) | Particle 1 | Titanium B (1.0): Silica (0.5) |
| Comparative Example 5 | (9) | Particle 1 | Titanium B (0.8) |
| Comparative Example 6 | (10) | Particle 1 | Silica (0.4) |
| Comparative Example 7 | (11) | Particle 2 | Titanium B (1.0); Silica (0.2) |

Evaluations of the Characteristic Values

Developers were prepared by mixing the toner samples (1) to (11) and the carrier in ratio of 8/92 (weight ratio). The amounts of electrostatic charge of these developers were measured. Fogs in copied images, fine texture and ID were evaluated by using a copy machine EP-570 (made by Minolta Camera K.K.) for the evaluation of the toner samples of (1), (2), (5) and (7) to (10), and a copy machine in which EP-570 was modified to a developing machine of oil-coated roller type for the evaluation of the toner samples (3), (4), (6) and (11).

Fogs in Copied Images

Copied images were formed were formed in the combinations of each kind of toner and carrier by the copy machines as described above. As for fogs in copied images, fogs of the toner on the white ground were evaluated and ranked. The ranks better than those marked with Δ are practically applicable but those marked with ○ or better are desirable.

Fine Texture in Copied Images

Copied images were formed in the combinations of each kind of toner and carrier by the copy machines as described above. As for fine texture of copied images, fine textures of the half-tone images were evaluated and ranked. The ranks better than those marked with Δ are practically applicable but those marked with ○ or better are desirable.

Image Density (I.D)

Copied images were formed under an optimum condition of light-exposure. The image density of copied solid images was measured by using Sakura photodensitometer to be ranked. The ranks better than those marked with Δ are practically applicable but those marked with ○ or better are desirable.

Evaluation of Fluidity of Toner

Fluidity of toners was evaluated referring to bulk density of the toners to be ranked as below;

| | | |
|---|---|---|
| Bulk density; | 0.360 or more | ○ |
| | 0.340 to 0.360 | Δ |
| | 0.340 or less | X |

The ranks better than those marked with Δ are practically applicable but those marked with ○ or better are desirable.

Environmental Variation of Electrostatic Charge

The amount of electrostatic charge ($Q_{LL}$) was measured after storage of the developer in the environment of the temperature of 10° C. and relative humidity of 15% for 24 hours and the value ($Q_{HH}$) after the storage of 30° C. and 85% for 24 hours.

Difference ΔQ between them;

$$\Delta Q = Q_{LL} - Q_{HH} (\mu C/g)$$

was determined and the environmental variation of the electrostatic charge was evaluated to be ranked as below. The mark X shows that the environmental variation is too large for the practical application and the ranks better than those marked with Δ are practically applicable, but those marked with ○ or better are desirable.

The results of the evaluations were summarized in Table 2.

TABLE 2

| | Toner sample No. | Charge amount (μC/g) | Fogs | Fine texture | I.D. | Fluidity | Environment variation |
|---|---|---|---|---|---|---|---|
| Example 1 | (1) | −15.1 | ○ | ○ | ○ | ○ | ○ |
| Comparative Example 1 | (2) | −9.8 | X | Δ | ○ | Δ | Δ |
| Example 2 | (3) | −13.7 | ○ | ○ | ○ | ○ | ○ |
| Comparative Example 2 | (4) | −7.1 | X | X | ○ | Δ | Δ |
| Example 3 | (5) | −15.1 | ○ | ○ | ○ | ○ | ○ |
| Example 4 | (6) | −14.9 | ○ | ○ | ○ | ○ | ○ |
| Comparative Example 3 | (7) | −13.7 | ○ | Δ~X | ○ | Δ | Δ |
| Comparative Example 4 | (8) | −19.9 | ○ | ○ | X | ○ | X |
| Comparative Example 5 | (9) | −8.8 | X | X | ○ | X | Δ |
| Comparative Example 6 | (10) | −21.2 | ○ | ○ | X | Δ | X |
| Comparative Example 7 | (11) | −13.1 | ○ | X | ○ | X | Δ |

What is claimed is:

1. A toner for developing electrostatic latent images, comprising a thermoplastic resin, titanium oxide having a maximum value in particle size distribution within the range of 10 to 20 mμ and titanium oxide having a maximum value in particle size distribution within the range of 30 to 60 mμ, or comprising a thermoplastic resin, aluminum oxide having the maximum value in particle size distribution within the range of 10 to 20 mμ and aluminum oxide having a maximum value in particle size distribution within the range of 30 to 60 mμ;

wherein the amount of the titanium oxide or aluminum oxide is 0.2 to 3.0% by weight on the basis of the toner and wherein the ratio of titanium oxide or aluminum oxide of maximum value in particle size distribution of 10 to 20 mμ to that of 30 to 60 mμ is a ratio of 1:9 to 1:1.

2. A toner of claim 1, in which the titanium oxide or the aluminum oxide is subjected to a hydrophobic treatment.

3. A toner of claim 1, in which the titanium oxide or the aluminum oxide adheres to the surface of the toner particles by being mixed and stirred with toner particles.

4. A toner of claim 3, in which the toner particles comprise at least a polyester resin and a coloring agent.

5. A toner of claim 4, in which the polyester resin comprises a modified polyester prepared by a graft-polymerization of an unsaturated polyester with an aromatic vinyl monomer.

6. A toner of claim 5, in which the amount of the modified polyester occupies 50% by weight or less of the polyester resin constituting the toner particle.

7. A toner for developing electrostatic latent images comprising a thermoplastic resin, silica, titanium oxide having a maximum value in particle size distribution within the range of 10 to 20 mμ and titanium oxide having a maximum value in particle size distribution within the range of 30 to 60 mμ, or comprising a thermoplastic resin, silica, aluminum oxide having the maximum value in particle size distribution within the range of 10 to 20 mμ and aluminum oxide having a maximum value in particle size distribution within the range of 30 to 60 mμ;

wherein the amount of the titanium oxide or aluminum oxide is 0.2 to 3.0% by weight on the basis of the toner and wherein the ratio of titanium oxide or aluminum oxide of maximum value in particle size distribution of 10 to 20 mμ to that of 30 to 60 mμ is a ratio of 1:9 to 1:1.

8. A toner of claim 7, in which the silica, the titanium oxide and the aluminum oxide are subjected to a hydrophobic treatment.

9. A toner of claim 7, in which the silica and the titanium oxide, or the silica and aluminum oxide adhere to the surface of the toner particles by being mixed and stirred with the toner particles.

10. A toner of claim 9, in which the silica has a primary particle size of 5 to 20 mμ.

11. A toner of claim 10, in which the amount of addition of the silica is 0.1 to 1.0% by weight on the basis of the toner.

12. A toner of claim 7, in which the toner particles comprise at least a polyester resin and a coloring agent.

13. A toner of claim 12, in which the polyester resin comprises a modified polyester prepared by a graft-polymerization of an unsaturated polyester with an aromatic vinyl monomer, and the amount of the modified polyester in the polyester resin constituting the toner particles is 50% by weight or less.

14. A toner for developing electrostatic latent images, characterized in that toner particles composed of a thermoplastic resin and a coloring agent are mixed and stirred with inorganic fine particles subjected to a coating and hardening treatment by an alkyl polysiloxane, and to adhere the inorganic fine particles to the surface of the toner particles, said alkyl polysiloxane having a repeating structural unit represented by the following formula [I]:

[I]

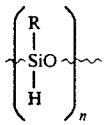

in which R represent an alkyl group which may be branched, n is an integer of 30 to 50, and having no functional groups that react with —OH groups at their molecular terminal.

15. A toner of claim 14, in which the amount of the alkyl polysiloxane is 1 to 15% by weight on the basis of the amount of the inorganic fine particles.

16. A toner of claim 14, in which the inorganic fine particles are titanium oxide having a maximum value in particle size distribution within the range of 10 to 20 mμ and titanium oxide having a maximum value in particle size distribution within the range of 30 to 60 mμ, or aluminum oxide having a maximum value in particle size distribution within the range of 10 to 20 mμ and aluminum oxide having a maximum value in particle size distribution within the range of 30 to 60 mμ;

wherein the amount of the titanium oxide or aluminum oxide is 0.2 to 3.0% by weight on the basis of the toner and wherein the ratio of titanium oxide or aluminum oxide of maximum value in particle size distribution of 10 to 20 mμ to that of 30 to 60 mμ is a ratio of 1:9 to 1:1.

17. A toner of claim 14, in which the inorganic fine particles are silica with a primary particle size of 5 to 20 mμ.

18. A toner for developing electrostatic latent images, characterized in that light-transmittable toner particles composed of a polyester resin and a coloring agent are mixed and stirred with hydrophobic titanium oxide having a maximum value in particle size distribution within the range of 10 to 20 mμ and titanium oxide having a maximum value in particle size distribution within the range of 30 to 60 mμ, or aluminum oxide having a maximum value in particle size distribution within the range of 10 to 20 mμ and aluminum oxide having a maximum value in particle size distribution within the range of 30 to 60 mμ;

wherein the amount of the titanium oxide or aluminum oxide is 0.2 to 3.0% by weight on the basis of the toner and wherein the ratio of titanium oxide or aluminum oxide of maximum value in particle size distribution of 10 to 20 mμ to that of 30 to 60 mμ is a ratio of 1:9 to 1:1; and said polyester resin having a number-average molecular weight of 2500 to 12000, number-average molecular weight/weight-average molecular weight of 2 to 6, glass transition temperature of 50° C. to 70° C. and melting point of 80° C. to 120° C.

19. A toner of claim 18, further comprising hydrophobic silica.

20. A toner of claim 18, having mean particle size of 6 to 12 μm.

21. A toner of claim 20, having mean particle size of 6 to 10 μm.

* * * * *